US012203719B1

(12) United States Patent
Hart et al.

(10) Patent No.: US 12,203,719 B1
(45) Date of Patent: Jan. 21, 2025

(54) SLEEVE FOR FIREARM AMMUNITION MAGAZINE

(71) Applicant: Heckler & Koch Inc., Columbus, GA (US)

(72) Inventors: Riley J. Hart, Columbus, GA (US); Bill Dermody, Ellerslie, GA (US); Nathaniel Schueth, Columbus, GA (US)

(73) Assignee: Heckler & Koch Inc., Columbus, GA (US)

( * ) Notice: Subject to any disclaimer, the term of this patent is extended or adjusted under 35 U.S.C. 154(b) by 0 days.

(21) Appl. No.: 18/158,493

(22) Filed: Jan. 24, 2023

Related U.S. Application Data

(60) Provisional application No. 63/302,230, filed on Jan. 24, 2022.

(51) Int. Cl.
*F41A 9/62* (2006.01)
*F41A 9/70* (2006.01)

(52) U.S. Cl.
CPC . *F41A 9/62* (2013.01); *F41A 9/70* (2013.01)

(58) Field of Classification Search
CPC .... F41C 23/16; F41A 9/62; F41A 9/70; F41A 9/64; F41A 11/00
USPC ..... 42/50
See application file for complete search history.

(56) References Cited

U.S. PATENT DOCUMENTS 4,587,756 A * 5/1986 Jakubaschk ..... F41A 9/62 42/50
7,631,751 B2 * 12/2009 Bubits ..... F42B 39/002 89/34
7,908,780 B2 3/2011 Fitzpatrick et al.
8,444,291 B2 * 5/2013 Swan ..... F41H 1/04 362/249.05
8,635,796 B2 1/2014 Fitzpatrick et al.
9,032,860 B2 5/2015 Faxon
9,593,902 B2 * 3/2017 Barnes ..... F41H 3/00
9,857,130 B2 * 1/2018 Purkiss ..... F41A 9/61
9,976,825 B2 5/2018 Faifer
10,030,923 B1 * 7/2018 Loveday, IV ..... F41A 9/70
10,094,636 B1 * 10/2018 Asbury ..... F41C 23/16
10,724,820 B1 * 7/2020 Zhang ..... F41A 35/02
2008/0196290 A1 * 8/2008 Bubits ..... F42B 39/002 42/96
2012/0174452 A1 * 7/2012 Anderson ..... F41A 9/65 42/49.01
2016/0010947 A1 * 1/2016 Barnes ..... F41C 23/16 42/90
2016/0334177 A1 * 11/2016 Green ..... F41A 3/66
2017/0191771 A1 * 7/2017 Zimmer ..... F41A 9/62
2022/0307784 A1 * 9/2022 Lee ..... F41A 9/62

FOREIGN PATENT DOCUMENTS

CH 580269 A5 9/1976
WO WO-2006133470 A1 * 12/2006 ..... F41A 9/65

* cited by examiner

*Primary Examiner* — John Cooper

(74) *Attorney, Agent, or Firm* — Wood Herron & Evans LLP

(57) ABSTRACT

A firearm ammunition magazine comprises a magazine body with at least one window therein through which cartridges in the magazine are viewable, and a sleeve surrounding the body and made at least in part of see-through material corresponding in location to the at least one window, whereby cartridges are viewable through the sleeve and the at least one window.

22 Claims, 6 Drawing Sheets

SLEEVE FOR FIREARM AMMUNITION MAGAZINE

RELATED APPLICATIONS

This application claims priority to U.S. Provisional Patent Application No. 63/302,230 filed Jan. 24, 2022, and incorporates the same herein by reference.

TECHNICAL FIELD

This invention relates generally to firearm ammunition magazines, and more particularly, to a sleeve for an ammunition magazine that transparently or translucently covers openings in sidewalls of the magazine body that allow the user to view cartridges in the magazine.

BACKGROUND

A removable stick or box magazine can have one or more window openings in the sidewall(s) of the magazine body to allow the user to see the number of cartridges remaining in the magazine. These open windows allow viewing and access for cleaning or lubrication, but also can allow dirt and debris to enter the magazine. Such magazine bodies are usually made of metal. Other magazines, usually ones made of polymer material, have transparent window panes that allow internal viewing, but the window pane material is typically integral with the polymer magazine body and is not separable.

SUMMARY OF THE INVENTION

The present invention provides a removable or permanent sleeve that may be positioned over a body of a magazine that has uncovered window openings or window openings covered in a transparent or translucent material in one or more sidewalls of the body of the magazine. The sleeve may be tubular and slide onto the body over the upper or lower end or may be formed from two or more parts and be secured together over the magazine body. The sleeve is made of a see-through material (transparent or translucent), at least in the area(s) that covers the window openings of the magazine body. The sleeve may be a ridged polymer material, such as polycarbonate, or may be made of a flexible material, such as silicone.

In another aspect, a firearm ammunition magazine comprises a magazine body with at least one window therein through which cartridges in the magazine are viewable, and a sleeve surrounding the body and made at least in part of see-through material corresponding in location to the at least one window, whereby cartridges are viewable through the sleeve and the at least one window.

The material can be transparent or translucent. The material can be rigid or flexible. If rigid, the material can be polycarbonate, polyetherimide, or nylon. If flexible, the material can be silicone. The sleeve can be removably or permanently installed to the body. The sleeve can include exterior features that enhance grip, such as texture or ridges. The sleeve can include an interior profile shaped to engage raised or recessed portions of an exterior profile of the body.

In another aspect, a sleeve adapted to surround a magazine body, the magazine body having at least one window therein through which cartridges in the magazine are viewable, comprises a material that is at least in part see-through corresponding in location to the at least one window, whereby cartridges are viewable through the sleeve and the at least one window.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1C:
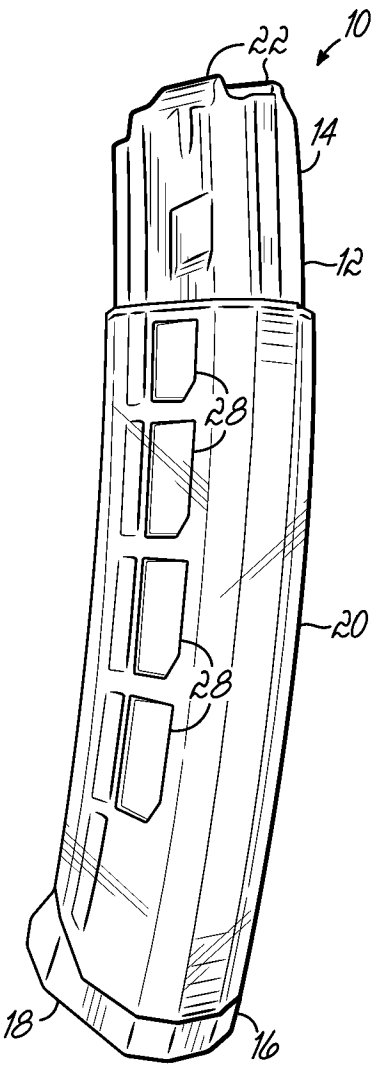
FIG. 1C is a second isometric view thereof.
Figure 1B:
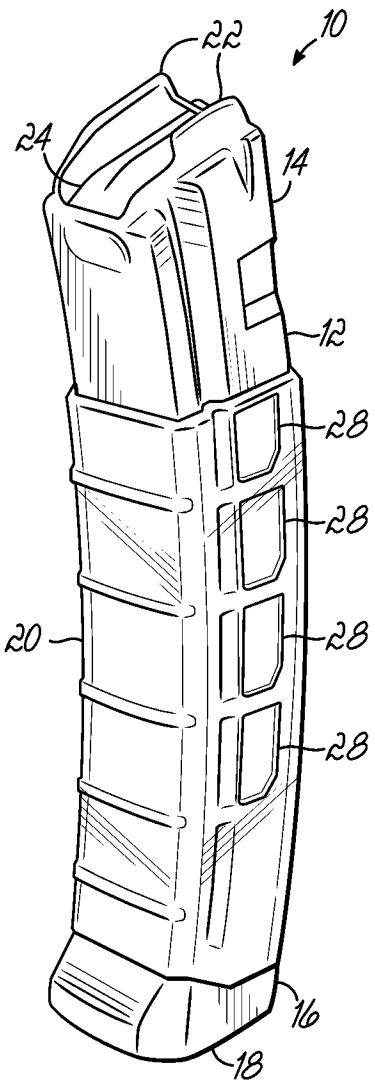
FIG. 1B is a first isometric view thereof.
Figure 1A:
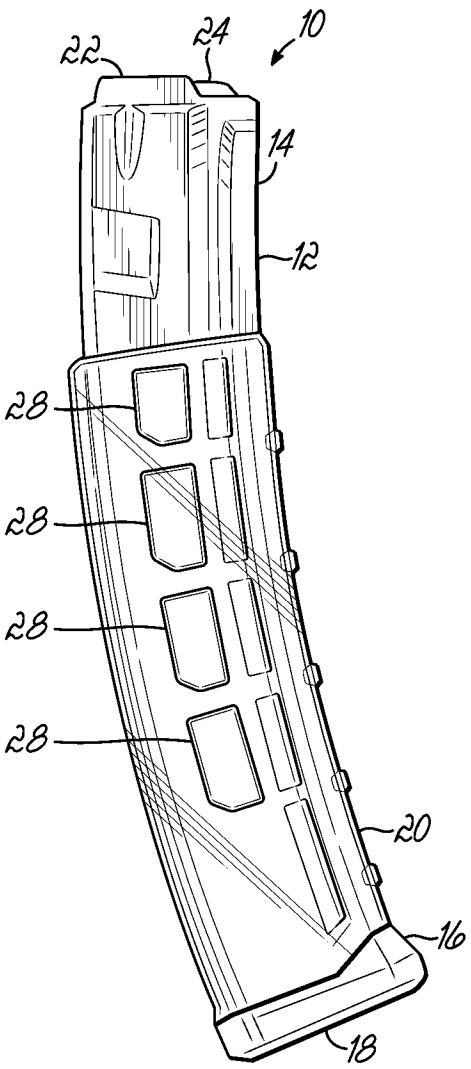
FIG. 1A is a side view of a removable firearm ammunition magazine and sleeve according to an embodiment of the present invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" will indicate the direction of the muzzle and the direction in which projectiles are fired, while "rearward" will indicate the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner.

Referring first to FIGS. 1A-C and 2, therein is shown a magazine assembly 10 comprising at least a magazine body 12 with open upper and lower ends 14, 16, a base plate 18, and a sleeve 20. The open upper end 14 includes feed lips 22 for presenting an ammunition cartridge (not shown). An internal follower 24, biased by a spring 26, advances cartridges toward the upper end 14 in a well-known manner. The base plate 18 attaches to the lower end 16 to provide a closure and against which the spring 26 will bear. The magazine body 12 may be made of formed metal, such as steel or aluminum, and includes one or more through openings in the form of windows 28. The windows 28 allow the stored cartridges to be viewed while allowing the body 12 to maintain guiding control of the cartridges. Alternatively, the magazine body may be made of polymer, and includes one or more through openings in the form of windows that have transparent or translucent window panes thereover that allow internal viewing.

The sleeve 20 is, at least in part, see-through. As used herein, "see-through" means it is substantially transparent or sufficiently translucent that a user can visually observe the presence or absence of cartridges loaded within the magazine body 12 through the window(s) 28. The sleeve 20 could be partially opaque with see-through area(s) corresponding to location(s) of window(s) 28 in the magazine body 12.

In the illustrated embodiment, the sleeve 20 is formed to closely fit the external surface profile of the magazine body 12. The interior profile of the sleeve 20 can be shaped to engage or fit recess(es) of the exterior profile of the magazine body 12 (including but not limited to the windows 20). The sleeve 20 may have at least some resiliency to allow slight deformation as it is installed and to closely fit or grip the exterior surface of the magazine body 12 to stay in place during use. In other embodiments, the sleeve 20 can be secured by other means, including without limitation, by adhesive or mechanical fasteners.

Figure 2:
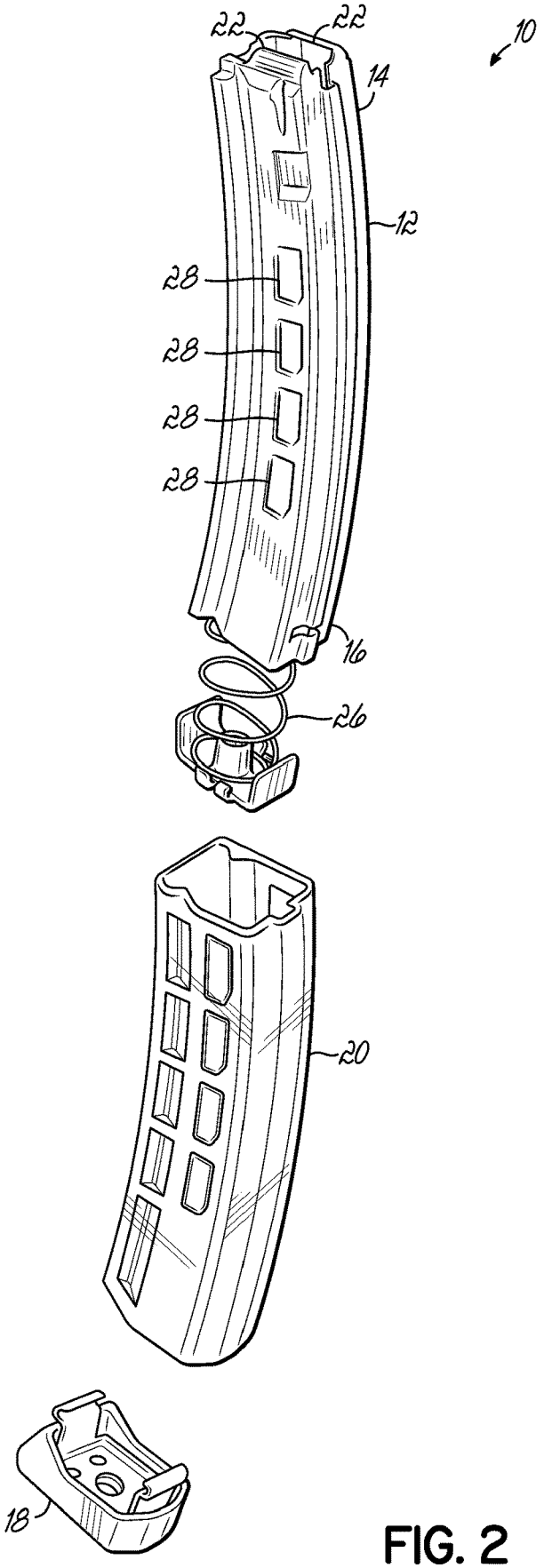
FIG. 2 is an exploded isometric view thereof.
Figure 3C:
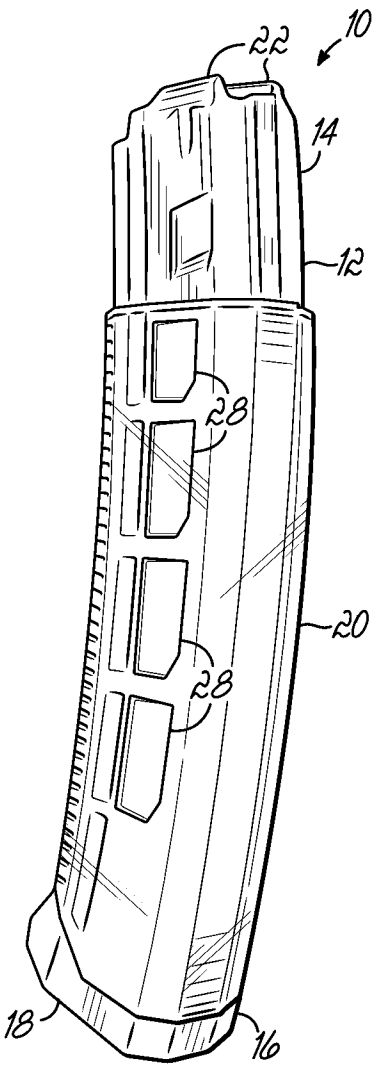
FIG. 3C is a second isometric view thereof.
Figure 3B:
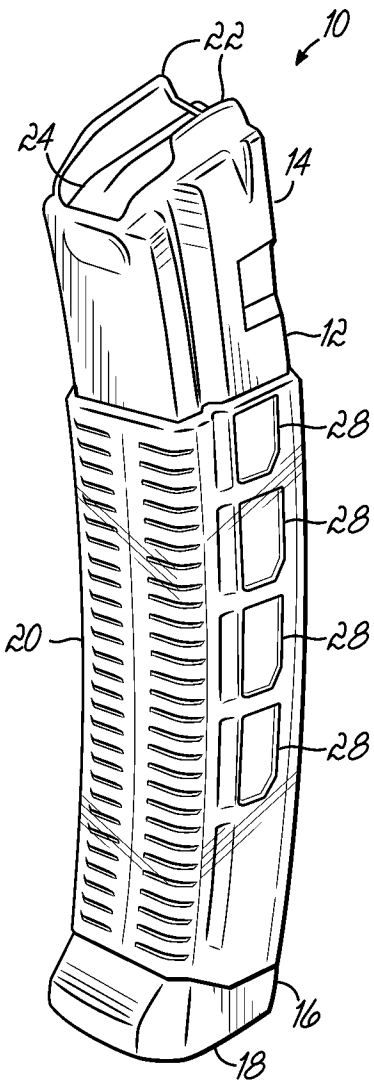
FIG. 3B is a first isometric view thereof.
Figure 3A:
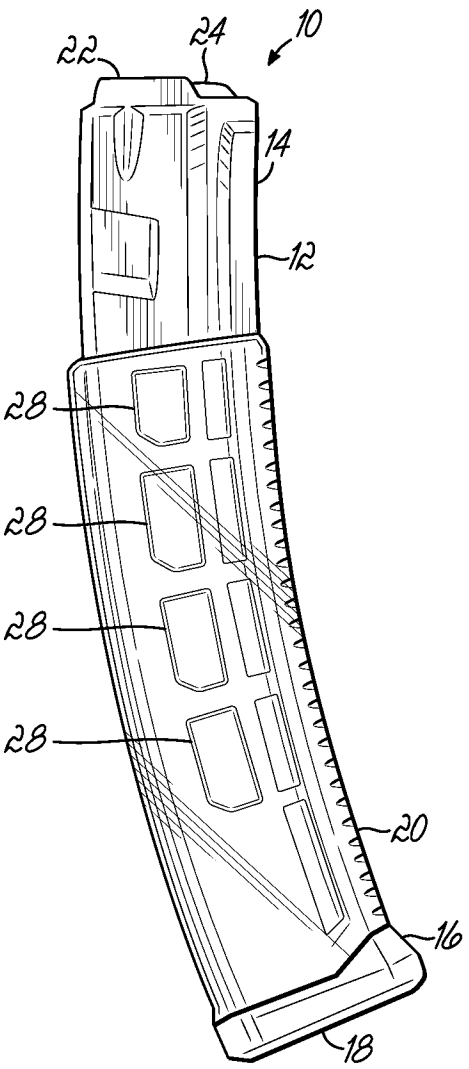
FIG. 3A is a side view of a second embodiment of the present invention.
Figure 4C:
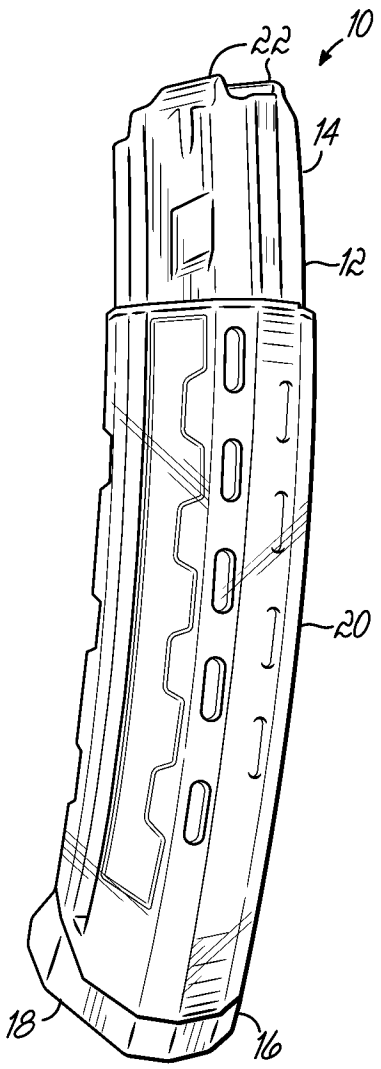
FIG. 4C is a second isometric view thereof.
Figure 4B:
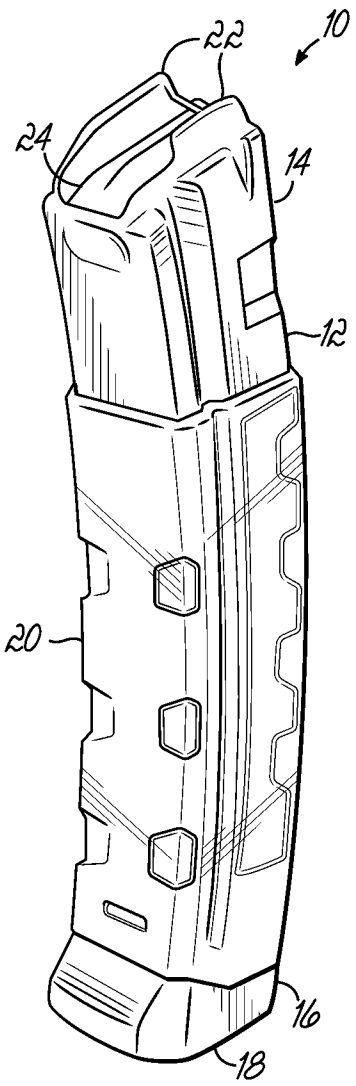
FIG. 4B is a first isometric view thereof.
Figure 4A:
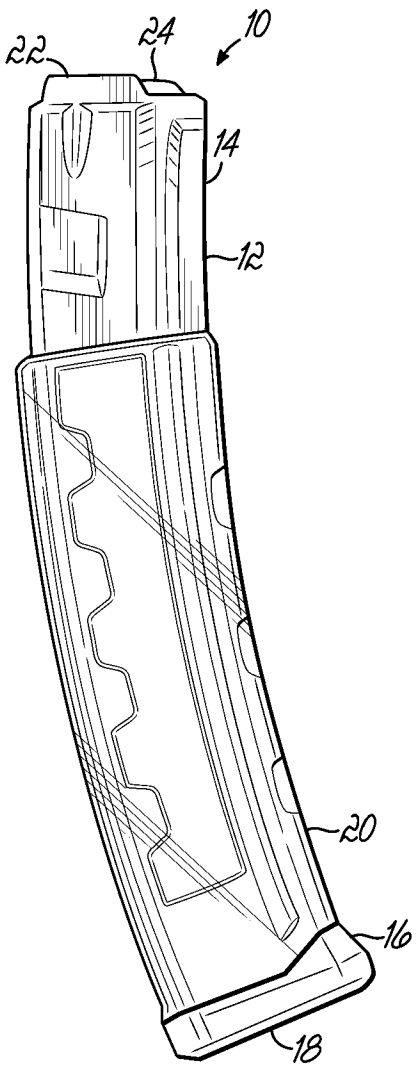
FIG. 4A is a side view of a second embodiment of the present invention.
Figure 5C:
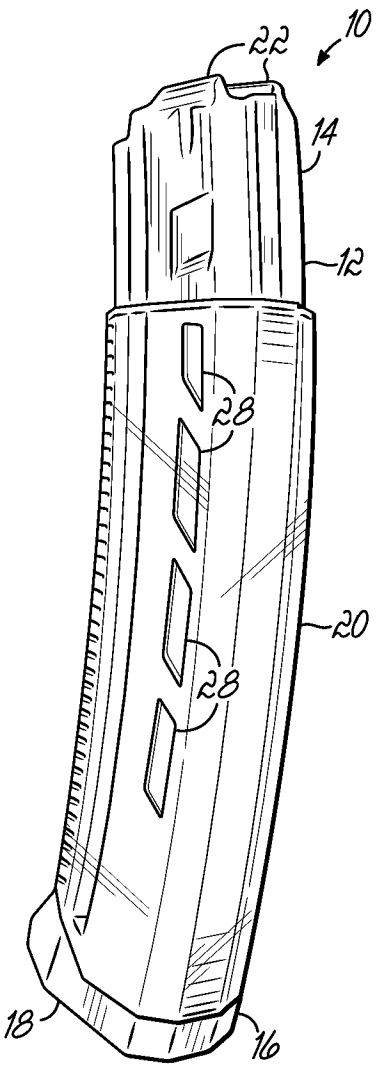
FIG. 5C is a second isometric view thereof.
Figure 5B:
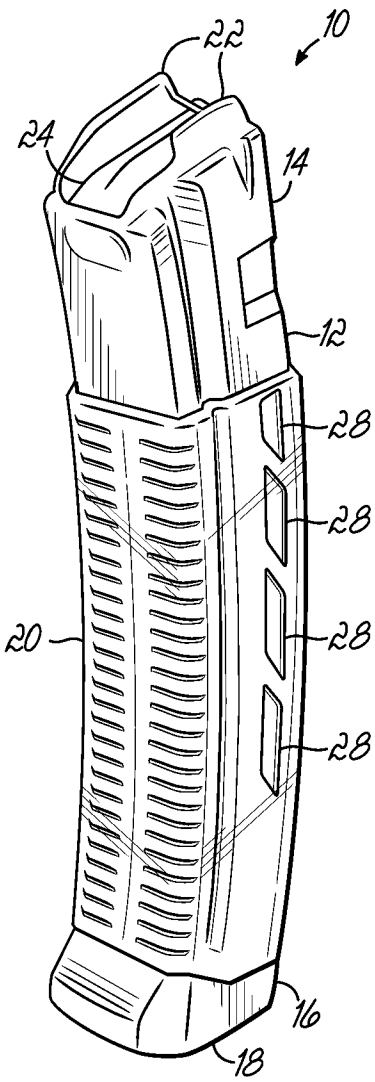
FIG. 5B is a first isometric view thereof.
Figure 5A:
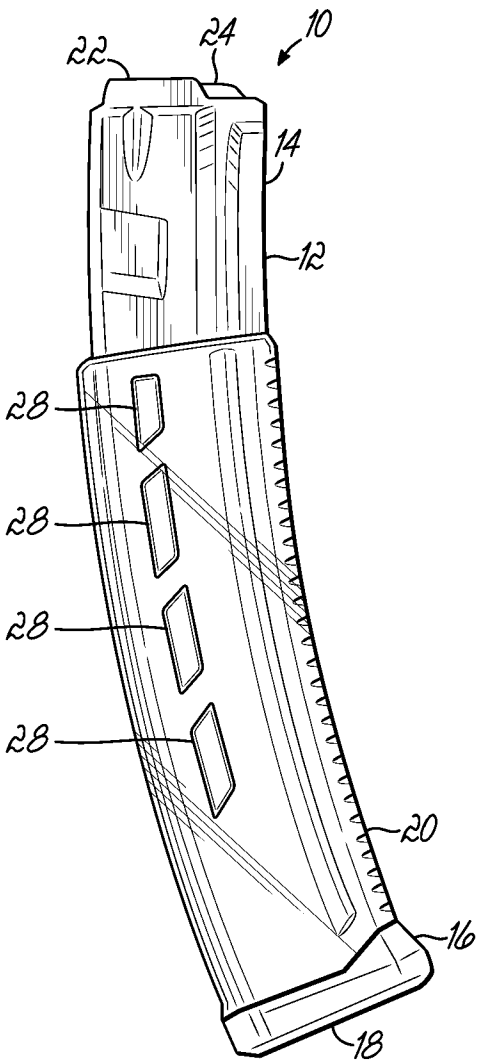
FIG. 5A is a side view of a second embodiment of the present invention.
Figure 6C:
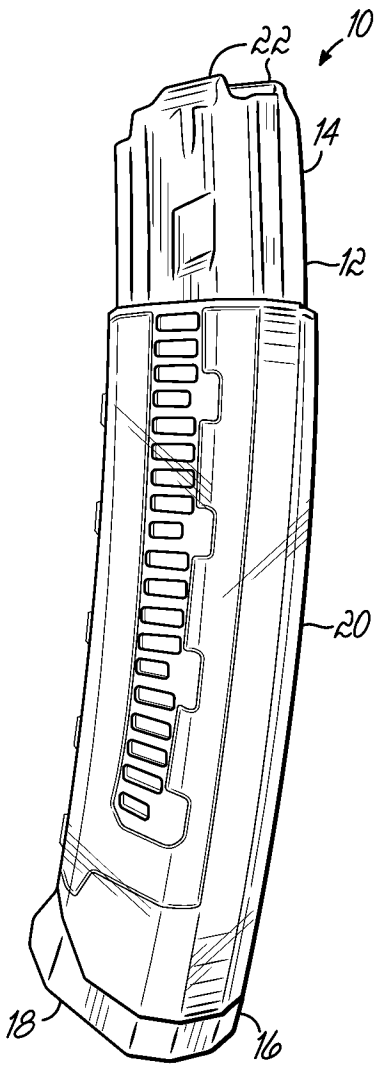
FIG. 6C is a second isometric view thereof.
Figure 6B:
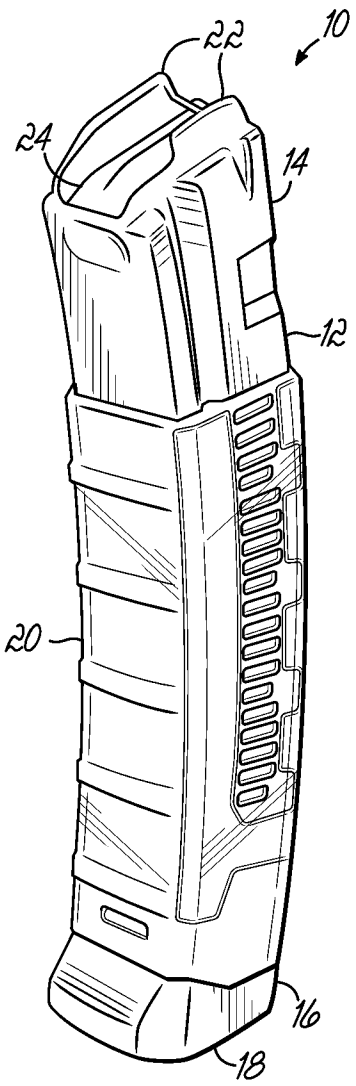
FIG. 6B is a first isometric view thereof.
Figure 6A:
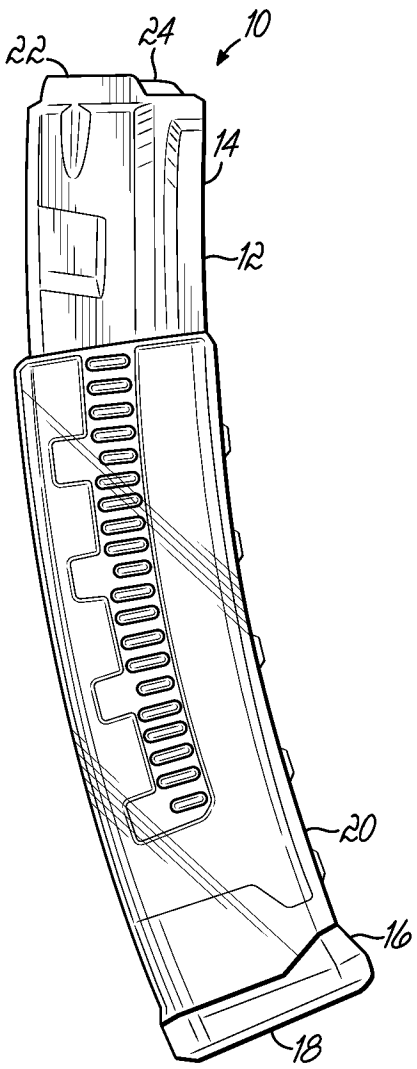
FIG. 6A is a side view of a second embodiment of the present invention.

Referring in particular to FIG. 2, the sleeve 20 can be installed by removing the basepad 18 to slide the sleeve 20 onto or off the magazine body 12. Or it could slide over upper end 14 of the magazine body 12. Alternatively, it can be of multi-part construction (such as longitudinally divided in half) that is detachably or permanently assemblable onto the magazine body 12. The sleeve 20 can be adapted and retrofit to existing magazines that have open windows, or it can be provided as part of an OEM assembly.

As shown in FIGS. 1A-C, 3A-C, 4A-C, 5A-C, and 6A-C, the sleeve 20 can have exterior surface features (such as texture and/or ridges) that are decorative and/or may be functional, such as to enhance grip. The sleeve 20 can be formed of a ridged polymer material (such as polycarbonate, polyetherimide or nylon) or a flexible material (such as silicone).

The present invention provides several distinct advantages, including the ability to see into a metal magazine without the ability of debris to enter. It can be configurable to match metal cut-outs for multiple design variants. It also provides an enhanced grip in the case of polymer magazines that have window panes covering the cartridge viewing window openings while still permitting cartridges in the magazine to be viewed. An opaque sleeve can be used if there is no desire for seeing available rounds.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A firearm ammunition magazine insertable into a receiver of a firearm, comprising:

a magazine body made of a material through which cartridges in the body are not viewable, the body having at least one window therein through which cartridges in the body are viewable, the body having a magazine catch recess, and a sleeve removably installed to and surrounding the body and made at least in part of see-through material corresponding in location to the at least one window, the sleeve having an open upper end, the upper end positioned below the magazine catch recess, whereby cartridges are viewable through the sleeve and the at least one window.

2. The magazine of claim 1 wherein the at least in part see-through material is transparent.

3. The magazine of claim 1 wherein the at least in part see-through material is translucent.

4. The magazine of claim 1 wherein the at least in part see-through material is rigid.

5. The magazine of claim 4 wherein the at least in part see-through material is selected from a group consisting of polycarbonate, polyetherimide, and nylon.

6. The magazine of claim 1 wherein the at least in part see-through material is flexible.

7. The magazine of claim 6 wherein the at least in part see-through material consists substantially of silicone.

8. The magazine of claim 1 wherein the sleeve includes exterior features that enhance grip.

9. The magazine of claim 8 wherein the exterior features are selected from a group consisting of texture and ridges.

10. The magazine of claim 1 wherein the sleeve includes an interior profile shaped to engage raised or recessed portions of an exterior surface profile of the body.

11. The magazine of claim 1 wherein the body material is selected from a group consisting of steel, aluminum, and polymer.

12. A sleeve adapted to be removably installed to and surround a magazine body of a firearm ammunition magazine that is insertable into a receiver of a firearm, the body made of a material through which cartridges in the body are not viewable, the body having at least one window therein through which cartridges in the body are viewable, the body having a magazine catch recess, the sleeve comprising:

a tubular member having an open upper end, the upper end adapted to be positioned below the magazine catch recess, the tubular member made of a material that is at least in part see-through corresponding in location to the at least one window, whereby cartridges are viewable through the sleeve and the at least one window.

13. The sleeve of claim 12 wherein the at least in part see-through material is transparent.

14. The sleeve of claim 12 wherein the at least in part see-through material is translucent.

15. The sleeve of claim 12 wherein the at least in part see-through material is rigid.

16. The sleeve of claim 15 wherein the at least in part see-through material is selected from a group consisting of polycarbonate, polyetherimide, and nylon.

17. The sleeve of claim 12 wherein the at least in part see-through material is flexible.

18. The sleeve of claim 17 wherein the at least in part see-through material consists substantially of silicone.

19. The sleeve of claim 12 wherein the sleeve includes exterior features that enhance grip.

20. The sleeve of claim 19 wherein the exterior features are selected from a group consisting of texture and ridges.

21. The sleeve of claim 12 wherein the sleeve includes an interior profile shaped so as to be adapted to engage raised or recessed portions of an exterior profile of the body.

22. The sleeve of claim 12 wherein the body material is selected from a group consisting of steel, aluminum, and polymer.

* * * * *